United States Patent [19]

Pratz et al.

[11] Patent Number: 4,491,251

[45] Date of Patent: Jan. 1, 1985

[54] SAFETY CAN FOR STORAGE OF LIQUIDS

[75] Inventors: Clarence L. Pratz, Wellsburg; Archimede DiClemente, Wheeling, both of W. Va.

[73] Assignee: Eagle Manufacturing Company, Wellsburg, W. Va.

[21] Appl. No.: 553,133

[22] Filed: Nov. 18, 1983

[51] Int. Cl.[3] ..... H47G 19/14; B67D 5/58

[52] U.S. Cl. ..... 222/469; 222/473; 220/318

[58] Field of Search ..... 222/469, 470, 473; 220/315, 317, 318

[56] References Cited

U.S. PATENT DOCUMENTS

| | | | |
|---|---|---|---|
| 2,014,582 | 9/1935 | Putz | 222/469 |
| 2,335,195 | 11/1943 | Packer | 222/470 |
| 2,574,876 | 11/1951 | Lebus | 222/473 |
| 2,838,212 | 6/1958 | Robertson | 222/473 |
| 3,469,747 | 9/1969 | Richmond, Jr. | 222/469 |
| 3,927,797 | 12/1975 | Flider | 220/318 |
| 4,065,024 | 12/1977 | Atwell | 220/318 |

*Primary Examiner*—George T. Hall

*Attorney, Agent, or Firm*—Parmelee, Miller, Welsh & Kratz

[57] ABSTRACT

On a safety can for the storage and dispensing of liquid fuel and other volatile liquids from which the contents usually are dispensed at more or less frequent intervals, the pouring spout of the can has a cover which is at a free end of a lever which is spring biased to normally keep the cover tightly closed. The can has a fixed lifting handle in the form of a flat arch in a central area of the top of the can with the top of the arch providing a hand grip removed from the spout and its cover, a secondary handle extending above the lever on which the cover is secured and pivotally secured through an upwardly offset connection to the lever toward the free end of the biased lever terminates in a hand grip parallel with but spaced radially from the hand grip formed by the flat arch. The can may be lifted by grasping the two parallel hand grips but the spout cover will remain closed until one's hand, grasping both grips is tightened to pull the hand grip of the secondary handle in a generally horizontal, or radial, direction toward the first to controllably lift the spout cover from the end of the spout to an open position. Up and down movement of said secondary handle is ineffective to open the cover, radial movement alone being ineffective except lifting the can with the secondary lever alone held the spout cover more tightly closed.

8 Claims, 4 Drawing Figures

SAFETY CAN FOR STORAGE OF LIQUIDS

This invention is for a storage can for the storage of liquids and particularly volatile and flammable liquids, and especially multi-gallon portable gasoline cans largely used in connection with mobile industrial, contracting, and agricultural equipment where the fuel tank must be replenished on the work site as contrasted to pump-operated tank filling equipment for over-the-road vehicles. The safety can also has other uses in other fields and is referred to as a safety can because, if it is not deliberately opened, flammable or noxious vapors cannot escape and the more improved ones are safe even if they are dropped or fall in an inverted position or strike some object which might permit the escape of liquids and/or vapors.

BACKGROUND

Safety cans of the type with which this invention is most commonly used (but without excluding vessels of other shapes or construction) have a seamless cylindrical body with an integral dome-shaped top. Near the periphery of the top there is an upwardly projecting spout commonly used both for filling the can with liquid or for pouring contents from the can into another receptacle such as, for example, the fuel tank of an industrial or other tractor, as well as machinery or fuel burners at some fixed location. This spout, instead of having a removable screw cap commonly used on smaller cans, such as used for lawn mowers, small boats and the like, has a closure cap suspended from the end of an overhanging lever which is spring biased to hold the spout cover firmly and tightly against the top of the spout.

In use, such vessels are generally lifted vertically and, while being so held in one hand, are then grasped by the other hand at the bottom and tilted. The extent of the tilt is pretty much gauged by the weight of the can, and when the spout is in proper relation for transfer of liquid from the safety can to the receiving vessel, the spring biased cover is opened to allow pouring from the safety can to the receiving vessel to proceed.

Various arrangements have heretofore been provided for effecting the opening of the cover. Certain prior art patents have contemplated the provision of a lifting handle pivoted to the top of the can in such manner that when the can has been lifted and is being rocked from a vertical position toward a horizontal position, the lifting handle will pivot from a plane normal to the plane of the top of the can to a plane approaching one parallel with the top of the can, and such relative change of position of the handle effects an opening of the spout cover. One serious object to this is that the spout cover starts to open as the vessel starts to tilt, whereas it is desirable, to prevent spillage and waste, to bring the pouring spout with the vessel tilted to an angle, according to whether the can is full, perhaps nearly half empty or below half full, into proper relation with the filling spout of the receiving vessel and then independently throttle the opening of the pouring spout. In other words, with the tilting of the can automatically effecting the opening of the pouring spout, proper or exact aim with respect to the receiving vessel without excessive spillage is difficult to achieve. In some environments spillage may be dangerous as well as wasteful. The problem is not unlike one encountered by a novice in pouring liquid from an open topped vessel into another vessel without the use of a funnel in the receiving vessel.

Others have sought to avoid the foregoing difficulty by providing a lifting handle associated with an independent spout covering operating linkage which, however, requires the relaxing, if not the complete momentary release, of the handle from which the weight of the front or top end of the tilted can receives its support, or the tilted can is perhaps rested against the tank which is to receive liquid while one changes one's grip. So far as I am aware such devices have not been commercially accepted.

BRIEF DESCRIPTION OF THE PRESENT INVENTION

The present invention overcomes the possiblity of premature opening of a spout cover, and provides an arrangement where the degree of opening may be more readily controlled with the natural opening or closing of the lifting hand of the user but without even momentarily relaxing full support of the suspended can, whether it be upright or tilted. Briefly, my improvement comprises the provision of a fixed primary lifting handle and a secondary movable lifting handle. While the can may be lifted by either handle alone, lifting with the secondary handle alone holds the cover on the pouring spout against any opening movement at all. Since the primary lifting handle is immovably fixed to the can, the lifting of the can with the primary lifting handle does not effect any operation of the pouring spout cover at all. The secondary handle may be rocked up and down with respect to the primary handle through a limited arc, but only when it is moved in a plane toward or away from the primary handle will it effect opening or closing of the pouring spout cover. This it does through a unique system of compound levers which also permits the degree of opening or closing of the spout cover in smaller increments more readily and with less tension on one's fingers than is required in prior attempts to achieve like controlled operation of the opening and closing of the pouring spout cover in conjunction with lifting the vessel and tilting it. Important to this invention is the relation of the lifting handle grips in parallelism to the axis in the wrist joint when the hand swings as opposed to a twisting action.

DETAILED DESCRIPTION OF THE DRAWINGS

Safety cans of the type to which this invention applies most commonly comprise a one-piece cylindrical body with a slightly rounded or dome-like integral top as herein illustrated, but the invention is applicable to cans of other contours and construction. The bottom of the vessel having such a one-piece body is not here shown but is a separately formed disk, the periphery of which is seamed to the lower end of the body. A pouring spout is provided on the top near the periphery of the vessel.

Figure 2:
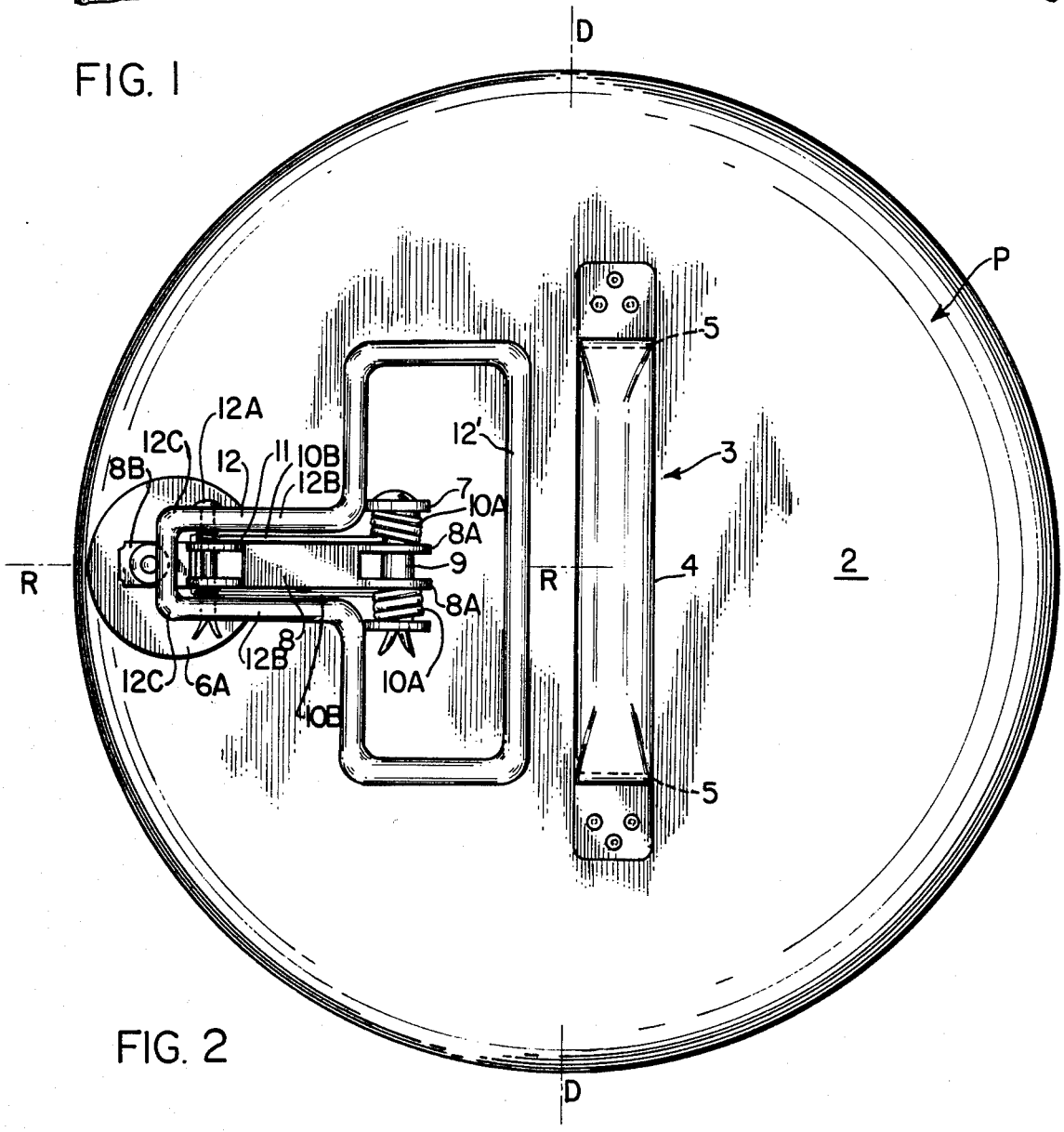
FIG. 2 is a plan view of the construction shown in FIG. 1 but without the friction washers shown in FIG. 3.

Assuming in the drawings that 2 represents the domed top of a cylindrical safety can, there is fixed to the top of the can a primary lifting handle 3 in the form of a flat arch having a grip bar 4 extending between upright supports 5 at each end, the bar being elevated well above the top of the can so that it may be easily grasped. The bar extends in a plane slightly to the right, as viewed in FIG. 2 of a diameter D, of the safety can top. The pouring spout 6 is located near periphery P of the cover centered in the vertical plane of a radius, R at right angles to the plane of the primary lifting handle. The handle grip of the flat arch is preferably spaced above the top at a level higher than the top of the spout.

There is a U-shaped bracket 7 secured to the top of the can between the pouring spout 6 and the primary lifting handle 3, its base being centered on radius R. There is what I term a "compound" crank lever 8 formed of pressed metal, the major portion of which is an inverted channel with parallel downturned arms 8A that extend between the arms of the U-shaped bracket 7. A pivot pin 9 passing transversely through the arms of the bracket 7 also passes through the arms 8A, providing a fulcrum about which the lever 8 may rock in a vertical arc. The outer end of the lever 8 has an outwardly extending tongue portion 8B that reaches radially part-way across the pouring spout 6. There is a cover 6A that fits over the pouring spout 6 and a central pin 6B connects this cover with overhanging tongue 8B of the lever 8.

The can as constructed has a pair of torsion springs 10A, one between each side of the lever arm 8A, and the upper terminal portions of the yoke 7, there being a bail-like extension 10B of the springs extending over lever 8, this arrangement normally exerting a strong pressure on lever 8 to keep the cover 6A tight against the top of the spout.

The reason I refer to lever 8 as a compound lever is that there is fixed thereto near its outer end an upwardly extending U-shaped bracket 11, not unlike the yoke on bracket 7 on the top of the can. A second lever 12, comprising a secondary handle is pivoted by transverse pin 12A to the upstanding arms of this bracket 11 near the outer end of lever 8.

This secondary handle 12 is desirably formed of rod or bar stock bent to provide a generally rectangular hand loop with a handle grip bar 12' parallel with but spaced from the grip bar 4 of the flat arch 3. This rectangular loop portion 12 is not completely closed but the sides of the loop at the opposite ends of the grip bar 12' form closely spaced parallel legs 12B, one at each side of lever 8, that extend to and beyond the upstanding bracket 11 on the lever 8, the spacing between extensions 12C being such as to extend across the lever 8.

Pivot pin 12A passes transversely through the two parallel extensions 12B and also between the upstanding terminal portions of bracket 11 whereby the secondary handle may rock in a vertical arc, up and down, with respect to lever 8 without moving said lever. The two ends of the parallel extensions, 12C, are turned inwardly toward each other, directly over the tongue 8B of the lever 8. If, then, one picks up the can by the grip bar of the secondary handle, as well he may, perhaps to move the can out of his way, the upper lift of the hand loop depresses extensions 12C against the underlying tongue 8B of lever 8 urging this end of the lever 8 to press the pouring spout cover 6A more firmly against the top of the spout to thereby prevent spilling of the can contents from the pouring spout by such more or less incidental lifting of the can by its secondary handle.

If the secondary handle has been so lifted and the can should fall so that the secondary handle should be pushed down, this would simply be an idle movement of the secondary handle in an arc about its pivot pin 12A without moving the lever 8 or the spout cover 6A in the least.

The only way that the spout cover may be lifted from the spout is by movement of the hand grip of the second handle in a horizontal direction toward the fixed grip bar of the primary lifting handle. Because the fulcrum of pivot pin 9 of lever 8 is offset below the longitudinal axis of the lever, while the fulcrum or pivot pin 12A for the secondary handle is at an effective level above the axis of lever 8 and above the fulcrum or pivot pin 9, the lateral travel of the secondary handle, exerting an over-center pull on the lever, rocks it upwardly about fulcrum or pivot pin 9 whereas no rocking movement of the secondary handle about fulcrum or pivot pin 9 exerts any lifting thrust on lever 8 at all. Of course, as lever 8 rocks upward, it lifts the spout cover 6A away from the spout.

According to the well-known principles of a lever, the further the force is applied to a lever from the fulcrum the less is the power required to move the lever. The cap cover 6A, on the other hand, is at practically the outermost end of lever 8 so that a small arc of movement at the fulcrum will be a greater distance of travel for the cap cover. This works out, with experience, so that the user of the can may control the degree of opening of the cover from the spout which can be nicely regulated to small increments of opening of the cap with relatively easy pull of the grip of the secondary handle toward the primary grip instead of snapping the cover from a closed position to a full open position, as would occur if the secondary handle were pivotally connected to the lever 8 close to its fulcrum. The controlled opening action of the spout cover made possible by the present invention is important in bringing a full, heavy can into pouring relation with the receiving spout of a receptacle into which liquid is being transferred.

The grip bars of both the primary and secondary handles, being parallel to each other and transverse to the direction of pull of gravity, both in lifting and in pouring, require no change of grip on the two handles after the can is lifted, while it is being tilted, or upon opening of the spout cover. The tightening of one's grip is all that is required after the can has been lifted, or when it is tilted to horizontal position and pouring is started. All movements are entirely natural because the axis about which one's hand pivots, the long axes of the two hand grips, and the axes about which the fingers of one's hand flex are at all times substantially parallel.

Finally, by providing the primary lifting handle in a plane at right angles to the radius on which the pouring spout is centered, the arm of the person lifting the can does not obstruct his line of vision, since he may at all times when the pouring operation so requires, look under the handle and see past each side of the pouring spout and enough of the cover to see how much it opens and be sure the spout is correctly positioned.

Figure 1:
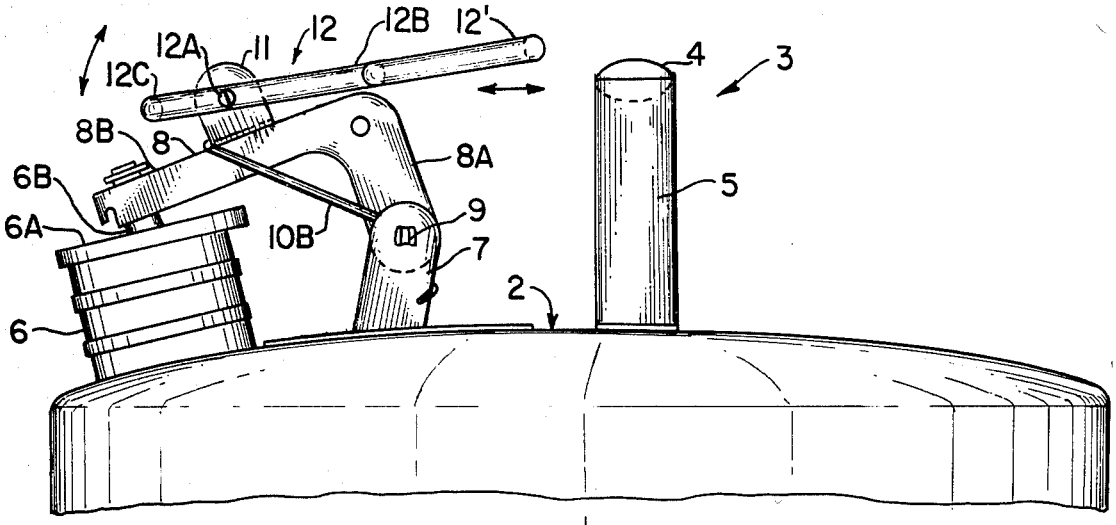
FIG. 1 is a side elevation showing the invention as embodied on the top of a can.
Figure 3:
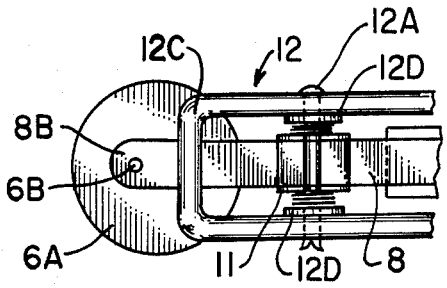
FIG. 3 is a fragmentary plan view of a modified pivot for the secondary lifting handle whereby if the secondary handle grip is lifted from its normal position where it rests on the dome of the can, it will remain at this elevation to which it is lifted, such as the elevated position shown in FIG. 1, instead of dropping back to the top of the can.
Figure 4:
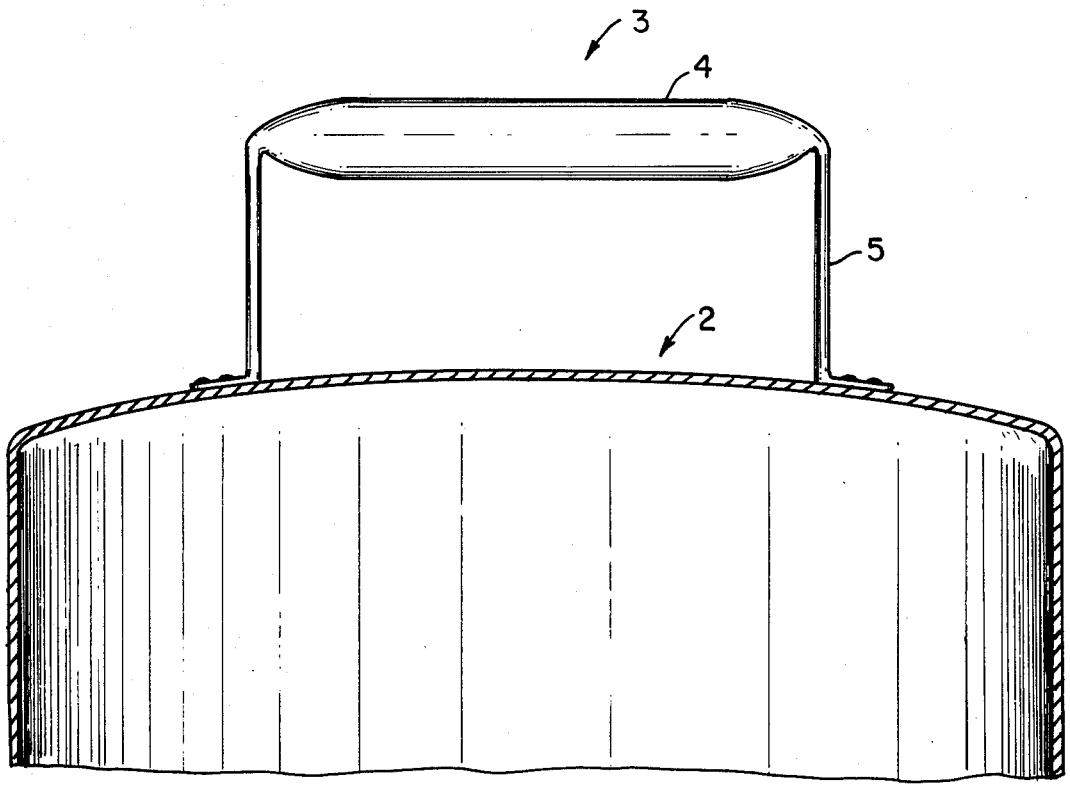
FIG. 4 is a fragmentary vertical section showing the primary lifting handle in elevation.

As usually constructed, the hand grip of the secondary handle will rock freely about pivot 12A, as shown in FIG. 1, and when it is released, gravity will bring the hand grip to rest on the dome of the can, from which position it may be again easily raised to the level shown in FIG. 1 preparatory to lifting the cover of the pouring spout. With the modified pivot arrangement for the secondary handle shown in FIG. 3, there are friction washers and springs 12D. with this modification, when the hand grip 12' is at just about the level of the fixed hand grip 4, it may be released from the grip of the user; but by reason of friction washers and springs pressing against the bars 12A of the secondary handle, the bar 12' will remain in the position shown until purposely or accidentally moved to a different position.

I claim:

1. A safety can comprising a vessel with a closed top with a pouring spout near the periphery of the top, a primary fixed lifting handle slightly off-center on the top with a hand grip extending in a direction at right angles to the radius on which the spout is centered, a first lever mounted on the cover between the spout and the handle pivoted near one end to swing in a vertical arc above said radius with its free end extending above the pouring spout, a cover for the pouring spout suspended from the free end of said lever, spring means biasing said first lever to yieldably hold the cover tightly over the pouring spout, a secondary handle comprising a second lever having a hand grip at its free end parallel with the hand grip of the primary lifting handle, said second lever having an overcenter pivotal mounting on said first lever near to but inwardly from the center of said cover, said secondary handle being arranged to transmit lifting motion to the first lever to raise the cover from the spout only when moved in the direction toward the primary lifting handle.

2. A safety can as defined in claim 1 wherein the can may be lifted against gravity by either the primary or the secondary handles, but both handles must be grasped in one hand for lifting and pouring to effect lifting of the cover from the spout while squeezing the hand grips of both handles to thereby exert movement of secondary handle toward the primary handle.

3. The invention defined in claim 2 wherein the secondary lifting handle exerts a tightening pressure on the spout if it alone is used to lift the can against gravity.

4. The improvement in claim 1 wherein the primary fixed lifting handle is in the form of a flat arch in which the hand grip is high enough above the can top and wide enough to look under the arch without obstruction from the hand or arm that is lifting the can, and which is simultaneously holding the two hand grips, to enable the one using the can to readily see the position of the pouring spout with relation to a receiving opening in a vessel into which contents of the safety can are to be poured.

5. The invention defined in claim 1 wherein the secondary handle comprises a bifurcated stem portion with a handle loop at the end which confronts the grip of fixed handle, said bifurcated stem portion enabling the secondary handle to straddle said first lever.

6. The invention defined in claim 1 wherein the overcenter pivotal mounting of the secondary handle includes friction means to retard the free swinging of said secondary handle about its pivot mounting of said first lever.

7. The invention defined in claim 1 wherein said first lever is a compound lever with a leg portion extending downward from the longitudinal axis of the lever with the pivot for the said lever being through said downward extending leg portion, providing an undercenter pivotal axis between the lever, and there is means positioned on said lever near its opposite end providing an overcenter pivotal connection between said first lever and the secondary handle which constitutes a second lever.

8. The invention defined in claim 7 in which the end of said secondary handle projects beyond the pivotal connection between it and said first lever and overhangs the end portion of the first lever from which the spout cover is suspended, whereby lifting of the can by said second handle effects such movement of the second lever on the first lever as to urge the cover more tightly in sealing contact with the spout.

* * * * *